US005392792A

United States Patent [19]

Banerjee et al.

[11] Patent Number: 5,392,792

[45] Date of Patent: Feb. 28, 1995

[54] REDUCED GAS PHASE CIGARETTE

[75] Inventors: Chandra K. Banerjee, Pfafftown; Henry T. Ridings, Lewisville, both of N.C.

[73] Assignee: R. J. Reynolds Tobacco Company, Winston-Salem, N.C.

[21] Appl. No.: 47,661

[22] Filed: Apr. 13, 1993

[51] Int. Cl.[6] ..... A24D 1/00; A24D 3/00

[52] U.S. Cl. ..... 131/336; 131/339; 131/360

[58] Field of Search ..... 131/360, 331, 336, 335, 131/339

[56] References Cited

U.S. PATENT DOCUMENTS

| | | | |
|---|---|---|---|
| 3,172,410 | 3/1965 | Miller | 131/336 |
| 3,860,011 | 1/1975 | Norman . | |
| 4,023,565 | 5/1977 | Norman . | |
| 4,273,141 | 6/1981 | Van Tilburg . | |
| 4,342,322 | 8/1982 | Sanford . | |
| 4,343,319 | 8/1982 | Cantrell . | |
| 4,362,171 | 12/1982 | Johnson et al. . | |
| 4,380,241 | 4/1983 | Horsewell . | |
| 4,393,885 | 7/1983 | Silberstein . | |
| 4,503,869 | 3/1985 | Cantrell et al. . | |
| 4,506,683 | 3/1985 | Cantrell et al. . | |
| 4,515,170 | 5/1985 | Cantrell et al. . | |
| 4,517,996 | 5/1985 | Vester . | |
| 4,540,005 | 9/1985 | Cantrell et al. . | |
| 4,574,820 | 3/1986 | Pinkerton et al. . | |
| 4,580,584 | 4/1986 | Reynolds et al. . | |
| 4,582,072 | 4/1986 | Sanford . | |
| 4,585,015 | 4/1986 | Silberstein . | |
| 4,617,946 | 10/1986 | Keith . | |
| 4,941,485 | 7/1990 | Perfetti et al. | 131/365 |
| 5,050,622 | 9/1991 | Raker et al. | 131/336 X |
| 5,092,353 | 3/1992 | Montoya et al. | 131/360 |

FOREIGN PATENT DOCUMENTS 59-196082 7/1984 Japan .

*Primary Examiner*—Jennifer Bahr

*Attorney, Agent, or Firm*—Grover M. Myers; George C. Myers, Jr.

[57] ABSTRACT

A cigarette includes a rod of smoking material, such as tobacco, to which is attached a mouthpiece that is substantially impervious to air and smoke except for an unfiltered axial bore or flow passage which extends through the mouthpiece. Unfiltered smoke flows from the rod to the interface between the rod and mouthpiece where it is substantially diluted with air and passes through the flow passage for delivery as unfiltered, air diluted smoke. The air dilution reduces the gas phase components of the unfiltered smoke thereby providing a smoother, better tasting cigarette.

14 Claims, 2 Drawing Sheets

REDUCED GAS PHASE CIGARETTE

FIELD OF THE INVENTION

The present invention relates to smoking articles and more particularly to a cigarette in which the smoke is unfiltered and air diluted so as to reduce the gas phase components of the smoke and provide the smoker with a smoother, better tasting cigarette.

BACKGROUND OF THE INVENTION

It is well known and conventional in the art to provide cigarettes and cigarette filters with means for introducing ventilating air into the cigarette for diluting the smoke stream. Such dilution of the smoke stream with air reduces the per puff quantity of particulate matter and gas phase components (e.g., CO and NO) contained in the cigarette smoke. It is likewise well known to employ a filter alone or in combination with air ventilation to further reduce the particulate matter in the smoke stream. Filtration does not, however, have any significant or measurable effect on the quantity of gas phase components in the smoke stream.

In general, filtration and air dilution also affect the pressure drop of a cigarette. Generally, filtration increases the pressure drop of the cigarette and air dilution decreases the pressure drop of the cigarette. Air dilution alone tends to reduce the pressure drop of an unfiltered cigarette to an unnacceptably low level. Accordingly, conventional cigarettes designed for low levels of particulate matter and gas phase components typically employ a combination of filtration and air dilution so as to provide an acceptable pressure drop along with the desired reduction in particulates and gas phase components.

It is also known to dilute unfiltered smoke with air to lower both the particulate matter and gas phase components of the smoke. For example, U.S. Pat. Nos. 4,393,885 and 4,585,015 disclose cigarette filters comprising a hollow coaxial tube through which all the smoke passes in an undiluted, unfiltered condition to the mouth end of the filter and an air pervious or porous cylindrical chamber surrounding the tube through which air passes to the mouth end of the filter where it is delivered with the undiluted, unfiltered smoke to the mouth of the smoker.

U.S. Pat. No. 4,506,683 discloses a ventilated mouthpiece for a smoking article comprising an air and smoke impervious core member having a plurality of smoke flow capillaries extending therethrough for delivering unfiltered smoke to the mouth end of the core member. Intermediate the length of the core member, ventilating air is introduced into a plenum chamber from which it passes through an axial channel to be commingled with the unfiltered smoke in a recess at the mouth end of the core.

U.S. Pat. Nos. 4,023,576; 4,380,241; 4,515,170; and 4,617,946 disclose mouthpieces for cigarettes in which unfiltered tobacco smoke is delivered to the mouth of the smoker and diluted with ventilating air at the mouth end of the mouthpiece at a point intermediate the ends of the mouthpiece.

It would be a desirable objective to provide a cigarette with the pressure drop characteristics of a conventional filtered cigarette and which has high air dilution so as to substantially reduce gas phase components to obtain a smoother smoke, yet has sufficiently high particulate matter in the smoke to provide the taste desired by the smoker.

SUMMARY OF THE INVENTION

The foregoing objective is accomplished according to the present invention by a smoking article, in particular, a cigarette which is constructed with a tubular mouth end part or mouthpiece connected end-to-end to a paper-wrapped rod of smoking material by tipping paper in the same manner as a conventional cellulose acetate filter plug is connected to a tobacco rod.

In one embodiment of the present invention, the mouth end part comprises an air and smoke impervious plug having a small diameter bore or capillary tube extending through the plug along the longitudinal axis thereof. In a second embodiment of the invention, the mouth end part comprises a plastic tube or sleeve with the mouth end open and the end confronting the tobacco rod formed with a recess or cup and being air and smoke impervious except for one or more orifices formed in the recess or cup. The small diameter bore or the orifice are sized to provide a pressure drop in the range preferred by most smokers. In both embodiments, air dilution holes are provided in the tipping paper and in the cigarette paper covering the tobacco rod at or adjacent the interface between the confronting ends of the impervious plug or sleeve and the tobacco rod.

In a third embodiment of the invention, the mouthpiece or mouth end part is formed in the manner of a conventional cellulose acetate filter except that an axial tube is provided in the filter rod and the cellulose acetate tow is densely packed around the tube to substantially increase the pressure drop across the filter thereby substantially reducing flow of smoke and air through the filter. The tow is additionally treated with a plasticizer, such as triacetin, to bond the cellulose acetate fibers together and to the axial tube resulting in a further increase in the pressure drop across the filter rod and a further reduction of flow therethrough up to substantially zero flow, i.e., impervious.

A fourth embodiment of the invention similar to the third embodiment involves applying a sufficient amount of adhesive or plasticizer to a cellulose acetate tow at or adjacent the mouth end of the filter rod to render the filter substantially impervious to smoke and air.

In the third and fourth embodiments, air dilution holes are provided in the tipping paper covering the filter and in the paper covering the tobacco rod at or adjacent the interface between the confronting ends of the filter and the tobacco rod. At least a portion of the diluent air in both the third and fourth embodiments flows to the interface between the filter and tobacco rod through the cellulose acetate tow in countercurrent flow to the flow of smoke and air through the tobacco rod. This countercurrent air flow reduces the amount of particulate material from the smoke that deposits onto the face of the filter confronting the tobacco rod.

In all embodiments, when the smoker draws on the cigarette, unfiltered smoke from the burning tobacco rod travels to the interface between the tobacco rod and the mouthpiece where it is diluted with air passing through the air dilution holes. Air diluted, unfiltered smoke then passes downstream through the small diameter bore or capillary of the plug or the impervious filter, or the orifice of the sleeve to the mouth of the smoker. Because the smoke is unfiltered, the level of particulate matter in the smoke is reduced only by the extent of the air dilution and not by filtration. Accordingly, a greater amount of air dilution can be employed to substantially reduce the gas phase components without an excessive reduction in the particulate matter, thereby providing a smoother, better tasting cigarette. Since the pressure drop of the cigarette is determined primarily by the diameter of the bore or capillary in the plug or impervious filter or, the orifice diameter in the sleeve, causing all the ventilating air to pass through the bore or orifice makes it easier to achieve a desired pressure drop over a greater range of air dilution levels without filtration.

Advantageously, the dilution or ventilating air travels radially inwardly around the circumference of the interface between the tobacco rod and the mouthpiece and, in some embodiments, in a counterflow direction through the filter toward the interface. The unfiltered smoke traveling toward the mouth end is thereby diverted toward and concentrated along the axis of the smoking article so that the major portion of the particulate matter in the smoke passes through the bore or orifice and is not deposited on the upstream face of the plug, impervious filter or sleeve.

With the foregoing and other objects, advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
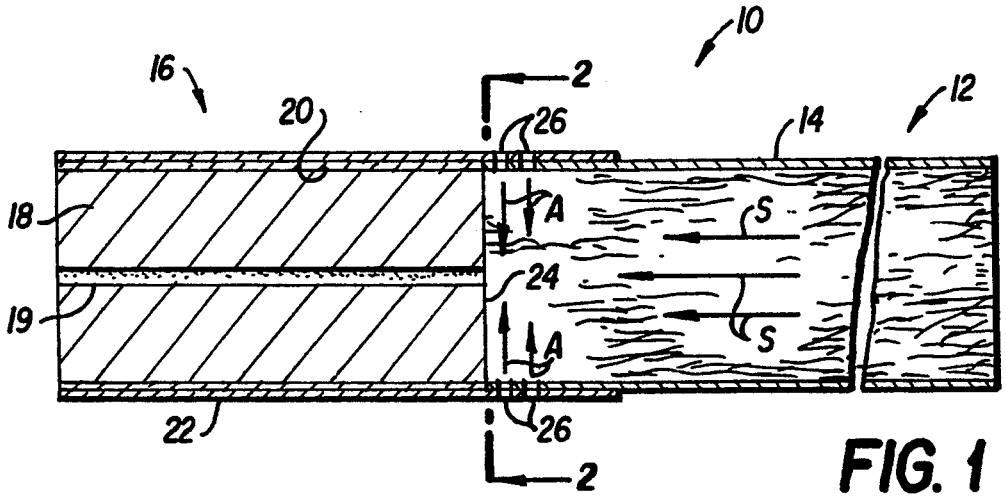
FIG. 1 is a broken longitudinal cross-section of a first embodiment of a cigarette according to the present invention.
Figure 2:
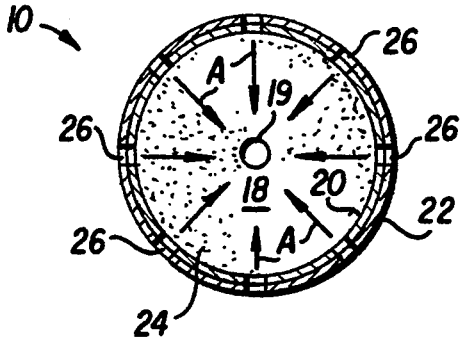
FIG. 2 is a transverse cross-section of the cigarette of FIG. 1 taken along line 2—2 thereof.

Referring now to the drawings wherein like parts are designated with like reference numerals throughout, there is illustrated in FIGS. 1 and 2 a first embodiment of the cigarette of the invention which is designated generally by reference numeral 10. Cigarette 10 comprises a cylindrical rod 12 of tobacco or other smoking material wrapped with a cigarette paper 14 and a mouthpiece 16 comprising an air and smoke impervious plug or rod 18 having a small diameter axial bore or capillary 19 extending therethrough. Plug 18 may be formed of any suitable material, such as a plastic material or cellulose acetate tow treated to render the same impervious to air and smoke or otherwise constructed with an impervious member to block flow of air and smoke through the tow. Plug 18 may be wrapped with a conventional paper overwrap 20.

The tobacco rod 12 is attached to the mouthpiece 16 by a tipping paper 22 in a conventional manner so that the downstream end of the tobacco rod 12 confronts the upstream end of the plug 18 at an interface 24. A plurality of air ventilation holes 26 are provided through the tipping paper 22 and cigarette paper 14 at or slightly upstream of the interface 24 between the tobacco rod 12 and the mouthpiece 16.

The diameter of the axial bore or capillary 19 in the mouthpiece plug 18 is selected to provide a desired total pressure drop for the cigarette, i.e., the tobacco rod and mouthpiece combination. A preferred pressure drop is in the range of about 60–125 mm $H_2O$. It has been found that the quantity of ventilating air (% dilution) has relatively little effect on the total pressure drop of the cigarette when all or substantially all the ventilating air passes through the bore or capillary 19. Accordingly, air dilution of 50% or more with little or no decrease in total pressure drop of the cigarette is readily achieved according to the present invention. A preferred range of air dilution according to the present invention is 25% to 75%.

In Table 1 below there is shown the measured pressure drop (PD) in mm $H_2O$ for various air dilution levels (% AD) of a cigarette made of a tobacco rod affixed to a filter rod made from a densely packed cellulose acetate tow (1.6/48,000 dpf). The filter rod has a length of 27 mm with a 0.042 inch inside diameter cellulose acetate tube extending axially through the filter rod.

TABLE 1

| PD | % AD |
|---|---|
| 94 | 31 |
| 96 | 40 |
| 92 | 57 |
| 90 | 63 |

For comparison purposes, a cigarette was made with the same tobacco rod as the cigarettes of Table 1. The tobacco rod was affixed to a typical cellulose acetate filter made with 3.3/39,000 dpf cellulose acetate tow without an axial tube and was air diluted 18%. The pressure drop of this cigarette was measured at 118 mm $H_2O$. The pressure drop of the same tobacco rod without a filter and with no air dilution was measured at 45 mm $H_2O$. All the above pressure drop measurements were based on FTC smoked cigarettes.

Referring again to FIGS. 1 and 2, when a smoker draws on the mouthpiece 16, ventilating air flows through air dilution holes 26 radially inwardly (as shown by the arrows A) toward the bore or capillary 19. This air flow mixes with the unfiltered smoke traveling longitudinally down the tobacco rod from right to left as depicted by the arrows S in FIG. 1. The unfiltered smoke is thus diluted with air, concentrated into a flow stream with a smaller cross-sectional area and directed toward the bore or capillary 19 from which it flows to the mouth of the smoker. The radially inward flow of air along the interface 24 helps to minimize the amount of particulate matter in the unfiltered smoke that is deposited on the upstream surface of the plug 18 and directs the unfiltered smoke to the smoker via bore or capillary 19 to provide the desired taste, notwithstanding a high level of air dilution. Concomitantly, the high level of air dilution results in a substantial reduction of the gas phase components of the smoke and thereby provides a smoother tasting cigarette.

Figure 3:
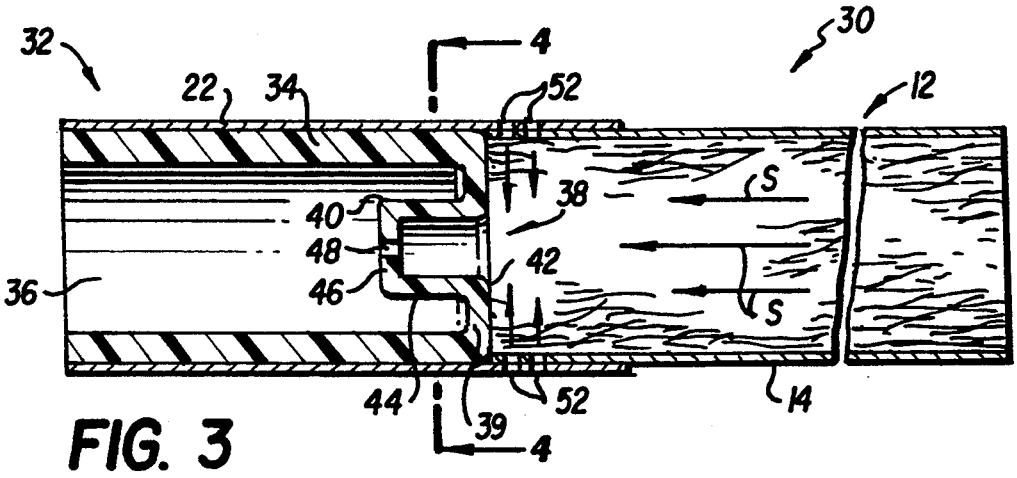
FIG. 3 is a broken longitudinal cross-section of a second embodiment of a cigarette according to the present invention.
Figure 4:
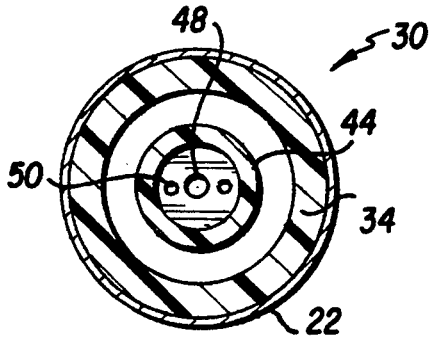
FIG. 4 is a transverse cross-section of the cigarette of FIG. 3 taken along line 4—4 thereof.

Referring now to FIGS. 3 and 4, a second embodiment of the cigarette of the invention is disclosed and is designated generally by reference numeral 30. Cigarette 30 also comprises a cylindrical tobacco rod 12 wrapped by a cigarette paper 14 and a mouthpiece 32 comprising an impervious plastic tube or sleeve 34 attached in end-to-end relation with the tobacco rod 12 by a tipping paper 22.

Plastic sleeve 34 is open at the downstream or mouth end 36 thereof. The upstream end 38 of the sleeve 34 is closed with an end cap 39 and is provided with an axial cup 40. End cap 39 abuts the downstream end of the tobacco rod 12 along an interface 42. The cup 40 is formed by a cylindrical wall 44 and a bottom wall 46 having one or more orifices 48, 50 extending therethrough. The total cross-sectional area of the orifices 48, 50 determines the pressure drop of the mouthpiece 32. Recessing the orifices 48, 50 from the interface 42 between the upstream end 38 of the mouthpiece and the downstream end of the tobacco rod 12 advantageously minimizes the possibility that loose tobacco strands from the rod 12 will block the flow through the orifices. It will be appreciated that the upstream or inlet end of the bore or capillary 19 in the FIG. 1 embodiment may be similarly recessed from the interface 24.

Air dilution holes 52 are provided through the tipping paper 22 and cigarette paper 14 about the periphery of the cigarette 30. Air dilution holes 52 advantageously function in the same manner as the air dilution holes 26 of the embodiment of FIGS. 1 and 2 to concentrate and direct unfiltered, air diluted smoke into the cup 40, through the orifices 48, 50 and out the mouth end 36 of the mouthpiece 32.

Figure 5:
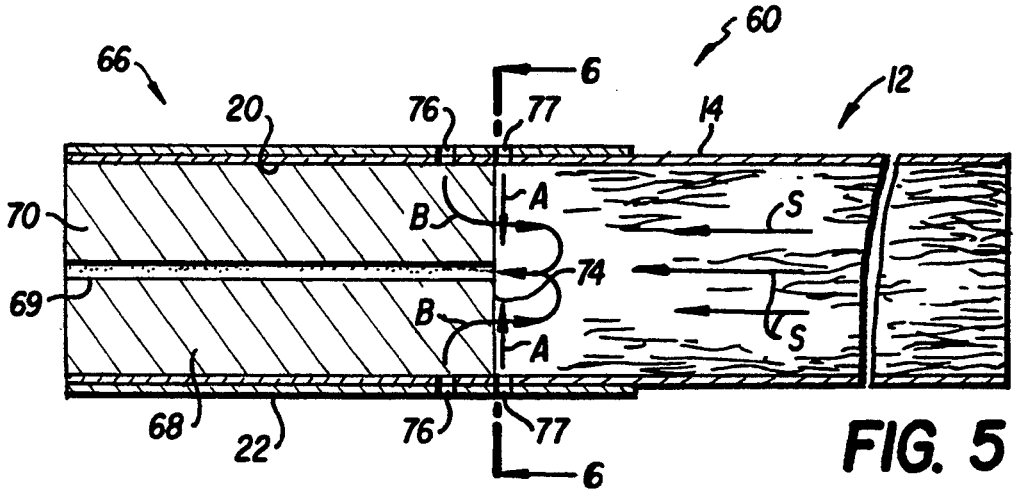
FIG. 5 is a broken longitudinal cross-section of a third embodiment of a cigarette according to the present invention.
Figure 6:
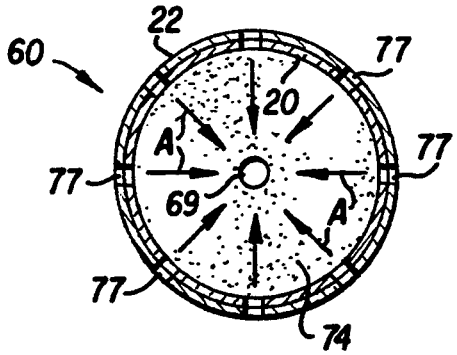
FIG. 6 is a transverse cross-section of the cigarette of FIG. 5 taken along line 6—6 thereof.

Referring now to FIGS. 5 and 6, a third embodiment of the cigarette of the invention is disclosed and is designated generally by reference numeral 60. Cigarette 60, like the first and second embodiments, comprises a cylindrical tobacco rod 12 wrapped by a cigarette paper 14 and a mouthpiece 66 comprising a filter plug or filter rod 68 having a small diameter axial tube 69, preferably made of cellulose acetate, extending therethrough. Plug 68 may be wrapped with a conventional paper overwrap 20. The tobacco rod 12 is attached to the mouthpiece 66 in the same manner as the first embodiment, namely, by tipping paper 22, so that the rod 12 confronts the plug 68 at an interface 74.

According to this embodiment, plug 68 is formed of a densely packed cellulose acetate tow which is treated with a plasticizer, such as triacetin, during manufacture. The plasticizer bonds the cellulose acetate fibers to each other and to the cellulose acetate tube 69 to create a very high pressure drop and thereby render the filter plug 68 virtually impervious to air and smoke at the pressure differentials contemplated by the invention.

Two rows of air ventilation holes 76, 77 may be provided through the tipping paper 22 and the cigarette paper 14 or overwrap 20 about the periphery of the cigarette 60. The holes 77 are preferably disposed at or adjacent the interface 74 between the upstream end of the mouthpiece 66 and the downstream end of the tobacco rod 12. Air dilution holes 77 function in the same manner as the holes 26 of the first embodiment and the holes 52 of the second embodiment in that the flow of air A through holes 77 concentrates and directs unfiltered, air diluted smoke into the tube 69 from which it flows into the mouth of the smoker. The holes 76 are preferably disposed in the mouthpiece 66 near the interface 74, e.g., between 2–5 mm downstream of the interface 74. At such distance, substantially all the ventilating air entering the holes 76 will be diverted in the upstream or counterflow direction as shown by the arrows B in FIG. 5 and thence into tube 69. Because of the substantially greater pressure drop or resistance to flow of the ventilating air through holes 76 in a direction toward the mouth end 70, little or no dilution air or smoke will pass to the mouth end through the tow of the densified filter rod. Advantageously, the counterflow of air B at the interface 76 helps to reduce the deposition of particulate matter onto the upstream face of the filter rod 68 and directs it toward the tube 69.

Figure 7:
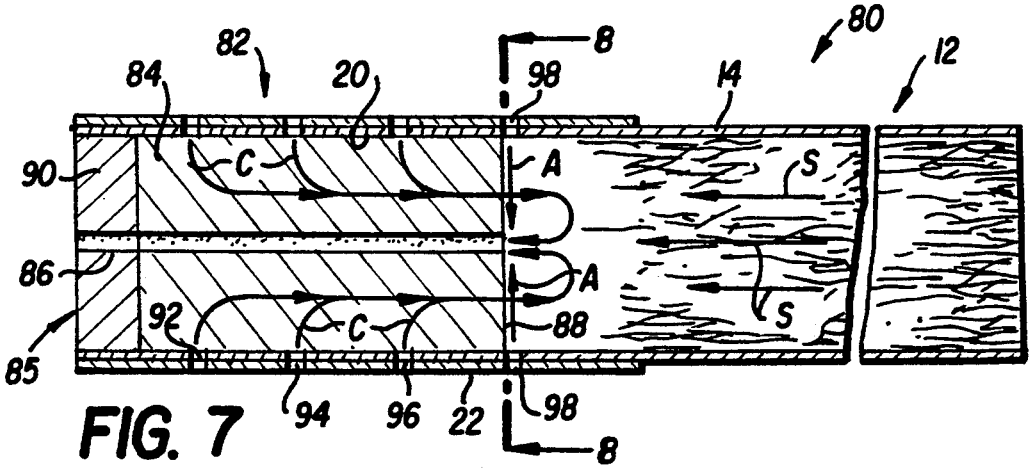
FIG. 7 is a broken longitudinal cross-section of a fourth embodiment of a cigarette according to the present invention.
Figure 8:
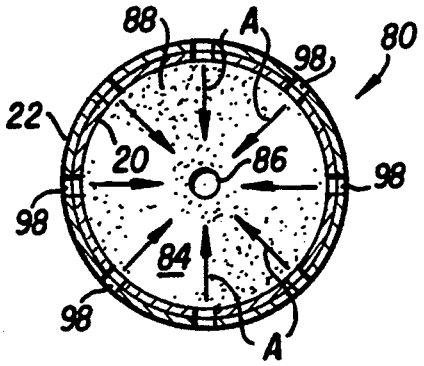
FIG. 8 is a transverse cross-section of the cigarette of FIG. 7 taken along line 8—8 thereof.

A fourth embodiment of the cigarette of the invention is illustrated in FIGS. 7 and 8 and is designated generally by reference numeral 80. Like the previous embodiments, cigarette 80 comprises a cylindrical rod 12 of tobacco or other smoking material wrapped in cigarette paper 14 and a mouthpiece 82. Mouthpiece 82 comprises a filter rod 84 with an axial bore 86, such as a cellulose acetate tube, extending therethrough. Filter rod 84 may be wrapped with a conventional paper overwrap 20. Tobacco rod 12 is attached to mouthpiece 82 in the same manner as the previous embodiments, i.e., by tipping paper 22, so that the tobacco rod 12 confronts the filter rod 84 at an interface 88.

According to the fourth embodiment of the invention, filter rod 84 is formed of a cellulose acetate tow which is treated with sufficient adhesive or plasticizer, such as triacetin, at the mouth end to render the filter rod impervious to air and smoke flow in a region 90 adjacent the mouth end 85 of the filter rod 84. The filter rod 84 may also be rendered impervious by affixing a cap or disc in the mouth end 85 of the filter rod with a central bore to accommodate the axial tube 86. Such a disc functions in the same manner as the impervious region 90 by preventing smoke and air flow through the filter rod in a direction toward the mouth end 85 of the smoking article.

A plurality of rows of air ventilation holes 92, 94, 96, 98 may be provided along the length of the mouthpiece 82 and at the interface 88 to admit the desired amount of air dilution of the smoke. Since the mouth end 85 is sealed at region 90 by a plasticizer or adhesive or by a cap or disc, ventilation air entering holes 92, 94 and 96 and passing into the tow of filter rod 84 flows in a countercurrent direction relative to the air and smoke flow S as shown by the arrows C in FIG. 7.

The dilution air A flowing through holes 98 at the interface 88 flows in a radial direction in the same manner as the airflow A in the previous embodiments. The flow of air C countercurrent to the flow of air and smoke across the interface 88 substantially reduces the deposition of particulate matter from the smoke on the upstream face of the filter rod to a negligible amount. The air flow C, coupled with the radial air flow A, directs virtually all of the particulate matter and smoke toward the central bore 86 of the filter rod 84.

EXAMPLE 1

A cigarette filter rod was made by densely packing 1.6/48,000 dpf (denier per filament) cellulose acetate tow made by the Hoechst Celanese Corporation of Charlotte, N.C. around a 0.042 inch ID cellulose acetate tube made by Sunlight Plastics, Inc. of Germantown, Wis. thereby forming a filter rod 24.4 mm in circumference. The densely packed tow was treated during manufacture with triacetin plasticizer in an amount of 8% to 9% by weight of plasticizer to tow to bond the cellulose acetate filaments to each other and to the central cellulose acetate tube. Filters of 27 mm length were made from the foregoing filter rod and attached in a conventional manner to 57 mm lengths of tobacco rod. Two rows of air dilution holes were made in the cigarette; one row was made in the filter 25 mm from the mouth end (2 mm from the interface between the tobacco rod and filter) and the other row was made at the interface between the tobacco rod and the filter. Table 1 above illustrates the pressure drop of this cigarette at various air dilution levels from 31% to 63%. At 63% air dilution, loss in particulate matter in the smoke owing to deposition on the upstream face of the filter was about 15%.

EXAMPLE 2

Cigarettes were made according to Example 1 except that the filter was rendered completely air and smoke impervious by covering the mouth end of the filter with a tipping adhesive. The loss in particulate matter from the smoke because of deposition onto the upstream face of the filter was negligible (less than 5%).

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A cigarette comprising a rod of smoking material having upstream and downstream ends, a mouthpiece having upstream and downstream ends and a longitudinal axis, the upstream end of said mouthpiece being attached to the downstream end of said rod and forming an interface at the confronting ends thereof, said mouthpiece being made of a material which is substantially air and smoke impervious between the upstream end to the downstream end of the mouthpiece, at least one axial flow passage extending through said mouthpiece along the longitudinal axis thereof from the upstream end to the downstream end thereof through which unfiltered smoke from said rod flows to the downstream end of said mouthpiece, and air dilution means in said rod of smoking material for admitting ventilating air through said smoking material and along said interface between said rod and said mouthpiece so as to mix with unfiltered smoke in said smoking material and at said interface such that unfiltered, air diluted smoke flows radially inwardly to the longitudinal axis of the mouthpiece and is delivered through said axial flow passage from the upstream to the downstream end of said mouthpiece, said air dilution means consisting of holes arranged about the cigarette and formed and arranged such that all ventilating air flowing to the downstream end of the mouthpiece is mixed with unfiltered smoke and flows to said interface and through said axial flow passage from the upstream end to the downstream end of the mouthpiece.

2. The cigarette of claim 1, wherein said mouthpiece comprises a cylindrical plug of plastic material extending the entire length of the mouthpiece from the upstream to the downstream ends thereof, said axial flow passage comprising an axial bore extending through said plug along the longitudinal axis thereof.

3. The cigarette of claim 2, including a cup-shaped recess in said plug at the upstream end thereof, said recess having a bottom and an open end confronting the downstream end of said rod of smoking material, said axial bore passing through the bottom of said recess.

4. The cigarette of claim 2, wherein said cylindrical plug comprises a plastic sleeve.

5. The cigarette of claim 1, wherein said mouthpiece comprises a densely packed tow of filamentary material, said flow passage comprising an axial tube disposed in said tow.

6. The cigarette of claim 5, wherein said tow comprises cellulose acetate filaments treated with a plasticizer to bond the filaments to each other and to the axial tube to render the tow substantially air and smoke impervious.

7. The cigarette of claim 5, including an air and smoke impervious cap closing the downstream end of the mouthpiece, said axial tube passing through said cap.

8. The cigarette of claim 7, wherein said cap comprises a plasticizer or adhesive applied to the downstream end of said mouthpiece.

9. The cigarette of claim 1, wherein said air dilution means comprises holes disposed about the periphery of the rod of smoking material upstream of said interface.

10. The cigarette of claim 9, including paper wrapped about said rod of smoking material, said holes being disposed in said paper.

11. The cigarette of claim 1, wherein the pressure drop of said smoking article is about 85–125 mm $H_2O$.

12. The cigarette of claim 1, wherein the air dilution effected by the air dilution means is in the range of 25% to 75%.

13. The cigarette of claim 2, including tipping paper wrapped about said rod of smoking material and said cylindrical plug for attaching said rod and plug together, said cylindrical plug having an outer peripheral surface, said tipping paper extending to the downstream end of the mouthpiece and covering the entire outer peripheral surface of said plug.

14. A cigarette comprising a rod of smoking material having upstream and downstream ends, a mouthpiece having upstream and downstream ends and a longitudinal axis, the upstream end of said mouthpiece being attached to the downstream end of said rod and forming an interface at the confronting ends thereof, said mouthpiece comprising a smoke impervious plastic sleeve with an end cap at the upstream end thereof, at least one axial flow passage extending through said end cap along the longitudinal axis of the mouthpiece through which unfiltered smoke from said rod flows to the downstream end of said mouthpiece, and air dilution means consisting of holes formed in said rod of smoking material upstream of said interface for admitting ventilating air through said smoking material to said interface so as to mix with unfiltered smoke at said interface, all ventilating air admitted to said cigarette flowing to said interface and passing through said at least one axial flow passage in said end cap to the downstream end of said mouthpiece whereby unfiltered, air diluted smoke flows radially inwardly to the longitudinal axis of the mouthpiece and is delivered through said axial flow passage to the downstream end of said mouthpiece.

* * * * *